US005325887A

United States Patent [19]

Egli et al.

[11] Patent Number: 5,325,887

[45] Date of Patent: Jul. 5, 1994

[54] CONNECTING DEVICE FOR A SANITARY APPLIANCE MIXING VALVE

[75] Inventors: Werner Egli, Wallisellen; Rene Dolder, Jona, both of Switzerland

[73] Assignee: Fides Trust AG, Zurich, Switzerland

[21] Appl. No.: 62,181

[22] Filed: May 17, 1993

[30] Foreign Application Priority Data

May 18, 1992 [CH] Switzerland ..... 1587/92

[51] Int. Cl.[5] ..... F16K 11/00

[52] U.S. Cl. ..... 137/270; 137/625.17; 137/360

[58] Field of Search ..... 137/270, 360, 625.17

[56] References Cited

U.S. PATENT DOCUMENTS

| | | | |
|---|---|---|---|
| 4,005,728 | 2/1977 | Thorp | 137/270 |
| 4,584,723 | 4/1986 | Hussauf | 137/270 X |
| 4,676,270 | 6/1987 | Knapp et al. | 137/625.4 |
| 4,821,765 | 4/1989 | Iqbal et al. | 137/270 |
| 4,846,207 | 7/1989 | Humpert et al. | 137/360 X |
| 5,095,934 | 3/1992 | Iqbal | 137/270 |

FOREIGN PATENT DOCUMENTS

| | | |
|---|---|---|
| 0309397 | 3/1989 | European Pat. Off. . |
| 3519763 | of 1986 | Fed. Rep. of Germany . |
| 3826064 | of 1989 | Fed. Rep. of Germany . |
| 2180744 | 11/1973 | France . |
| 2582696 | 12/1986 | France . |
| 8810386 | 12/1988 | PCT Int'l Appl. . |

*Primary Examiner*—Martin P. Schwadron
*Assistant Examiner*—Kevin L. Lee
*Attorney, Agent, or Firm*—Sughrue, Mion, Zinn, Macpeak and Seas

[57] ABSTRACT

A device for correcting interchanged pipe connections in a sink or bathtub faucet has a housing 1 with passages 10,11 for hot and cold water. From each passage tap lines 14, 15 run to a cylindrical recess 2 having a flat bottom 22. Discharge pipes 5,5' for mixed water are also led to the bottom by tap lines 16,17. The two feed tap lines 14,15 and, diagonally opposite, the discharge tap lines 16,17, empty centrally. A connector 6 installed in the recess 2 is provided with passages 34–37, which starting from annular channels 18–20 located at the bottom, lead to openings of feed pipes 24–27 in a fitting housing 9. The connector has two pieces, a central part 7 installed interchangeably by 180° in a peripheral part 8. The connector 6 can also be rotated by 180° on the housing 9, or by 360° together with the housing.

13 Claims, 4 Drawing Sheets

CONNECTING DEVICE FOR A SANITARY APPLIANCE MIXING VALVE

BACKGROUND OF THE INVENTION

This invention relates to a connecting device for a sanitary appliance mixing valve, such as a hot and cold water mixing valve for bathtub and shower outlets.

A connecting device for assembling a mixing valve to feed or discharge pipes, which were installed chaotically or interchanged, is described, for example, in German Offenlegungsschrift No. 3,826,064. A flush mounted branch fitting, which has continuous ducts for hot and cold water, is provided with tap pipes for connection with the fitting. Between the housing of the fitting and the branch fitting is an interchangeable connector, with which both correct and also interchanged hot-cold water feed can be attached. By inserting the tap lines in ring channels, even chaotically mounted feed pipes can be corrected by correspondingly rotating the housing of the fitting until the fitting itself is in the correct angular position.

A drawback with this connecting device is its relatively large total height and difficult standardization. For designs according to FIGS. 7 and 9 the distance between the housing and the branch fitting can be adjusted, but this possibility demands a significantly higher cost of production.

SUMMARY OF THE INVENTION

This invention provides a connecting device of the aforementioned kind which can be manufactured with a significantly smaller overall height, is simpler to standardize, and can be extended without significantly higher cost of production and assembly.

The device of the invention has the advantage that the connecting or intersecting point between the connector and the housing of the fitting can be flat, and to standardize the attachable fittings a single bore layout suffices.

DETAILED DESCRIPTION OF THE PREFERRED EMBODIMENT

Figure 1:
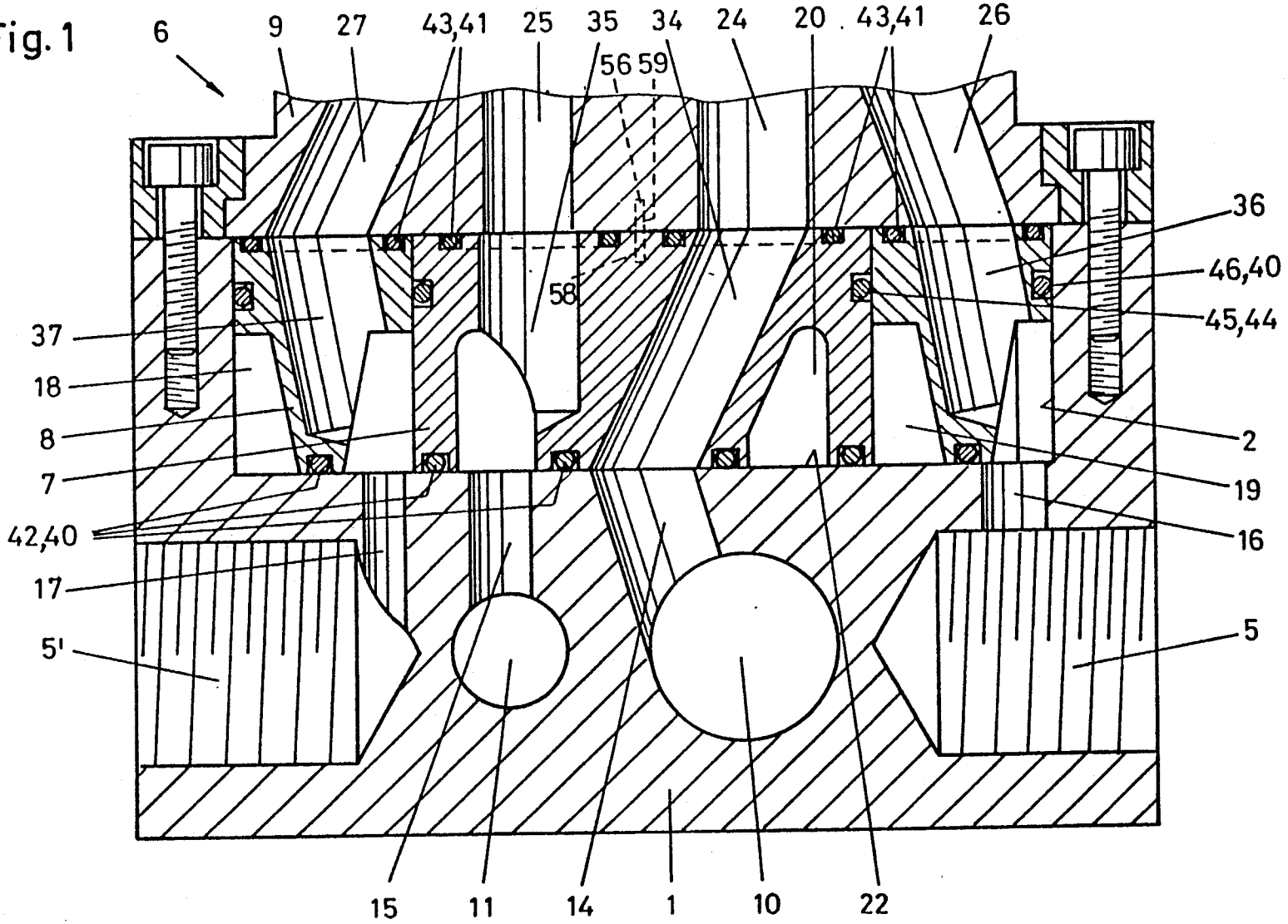
FIG. 1 is a sectional view of a connecting device according to the invention.
Figure 2:
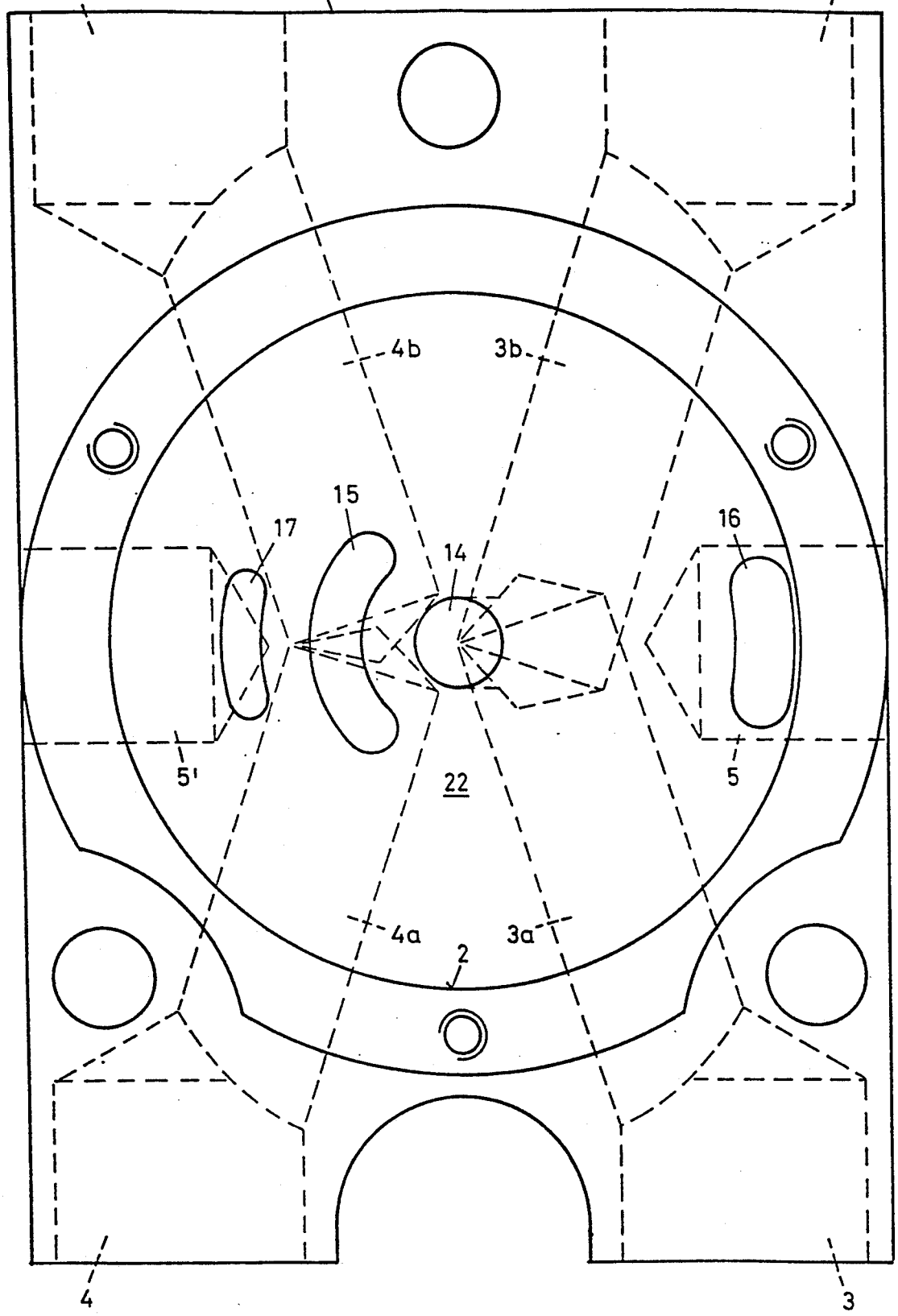
FIG. 2 is a top view of the outlet side of the tap lines of the connecting housing without the branch fitting.

The connecting device according to FIGS. 1 and 2 consists of a housing 1, to which hot and cold water feed pipes can be connected (not shown) at sockets 3, 4. The sockets are connected to opposing sockets 3',4' by continuous internal boreholes 3*a*, 3*b*, 4*a*, 4*b*, (10, 11 in FIG. 1) so that each housing 1 can be used as a passage line. Two other sockets 5, 5' are not connected together, but rather are formed as blind bores. From these the mixed water can be taken Both the connected sockets 3, 3', 4, 4' and the sockets 5, 5' for the mixed water are provided with tap lines 14, 15, 16, 17, which are essentially vertical to a plane formed by the sockets.

At the top the housing I has a cylindrical recess 2 with a flat bottom 22. The tap lines 14, 15, 16, 17 open into this bottom 22, and in particular a first tap line 14, which branches off from the connected sockets 3, 3' is centered relative to the cylindrical recess. A second tap line 15, which branches off from the connected sockets 4, 4', is kidney-shaped, so that it exhibits the necessary pipe cross section for the same amount of water as the circular central tap line 14. Thus, the tap lines 14, 15 for the feed pipes are arranged centrally or close to the center. The tap lines 16 and 17, which also have a kidney-shaped cross section, branch off from the sockets 5, 5' with sack-shaped feed pipe and form an external region.

The recess 2 receives a connector 6, consisting of a cylindrical central part 7 and a hollow cylindrical, peripheral part 8. With the above described arrangement of the tap lines 14, 15 for the feed pipes and the tap lines 16, 17 for the discharge pipes, the result is that the central part 7 is provided for the feed pipes and the peripheral part 8 is provided for the discharge pipes. Also conceivable is a design, where the connector 6 is inserted into a recess of a housing 9 of the fitting (not illustrated here).

Both parts 7, 8 of the connector 6 have passages 34, 35, 36, 37, which open into concentric annular chambers 18, 19, 20 at the bottom of the recess 2 or communicate with the central outlet of the tap line 14. On the opposite or upper side, the openings of the passages 34–37 are aligned with the openings of feed pipes 24, 25, 26, 27 in the housing 9. Here too, the feed lines 24 and 25 which feed water are arranged in the central region and the feed pipes 26, 27 which lead the water away are disposed in the peripheral region.

The communicating outlets of the tap lines 14–17, on the one hand, are aligned with the passages 34–37; the outlets of the passages 34–37, on the other hand, are aligned with the feed pipes 24–27 in such a manner that a rotation of 180° changes the allocation of feed pipes 24–27 and tap lines 14–17.

To exhaust all possibilities of interchangeability, the central part 7 of the connector with the passages 34, 35 can be interchanged with respect to the peripheral part 8, or the peripheral part 8 can be interchanged with respect to the central part 7. Thus, both the two discharge sockets 5, 5' and the two pairs of feed sockets 3, 3', 4, 4' can be interchanged among each other.

The annular chambers 18, 19, 20 and the central arrangement of the one feed pipe enable the two parts 7, 8 to be rotated as a whole by 360° so that any possible chaotic assembly and any possible crossing can be compensated for or corrected.

Seals are necessary between the annular chambers 18, 19, 20 and the central feed pipe of the tap line 14. For the sake of simplicity during production, there can be three concentric ring grooves 42 in the connector 6, in which three sealing rings 40 are correspondingly seated. Because the outermost annular chamber 18 is defined by the cylindrical wall of the recess 2 in the housing 1, an additional sealing ring 40 is seated on the side into a groove 46 of the connector.

Four suitable sealing rings 41 are situated in ring grooves 43 at the upper face of the connector, in order to seal the outlets of the passages 34–37 and the related outlets of the feed pipes 24–27. The central part 7 and the peripheral part 8 also have to be sealed with respect to each other, and to this end a peripheral groove 44 is provided in a cylindrical outside 50 of the central part, in which a ring seal 45 is seated.

The housing 1 can be provided with the necessary passages by drilling alone. The two parts 7 and 8 of the connector can be manufactured in a simple manner as plastic injection molded parts, and do not have to be subsequently machined.

Figure 4:
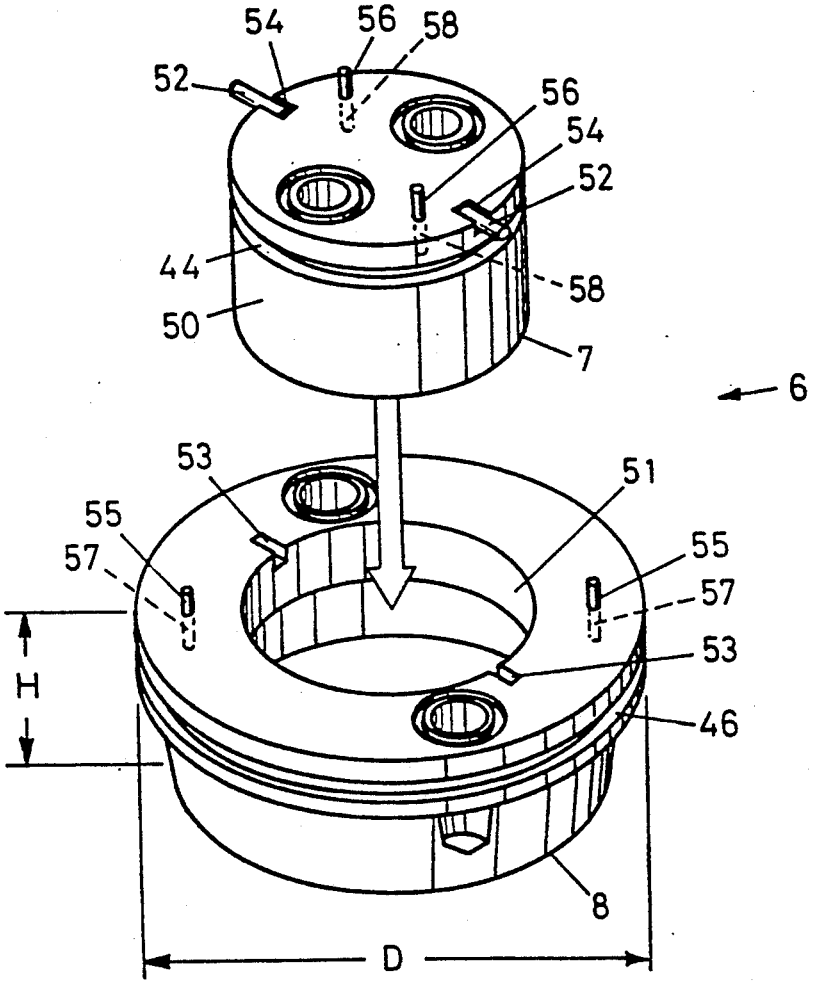
FIG. 4 is a perspective view of a connector, wherein the parts are pulled apart or exploded for illustration purposes.

As FIG. 4 shows, the peripheral part 8 exhibits a cylindrical recess 51, in which the central part 7 is inserted axially and sealed with the ring seal 45. With radially extending pins 52, whose ends engage with recesses 53 and 54 of the central part 7 and the peripheral part 8, these two parts 7 and 8 are connected together in a twist-proof manner. The pins 52 can be lifted out of the recesses 53 with the central part 7. Thus, the central part 7 can be easily rotated by 180° in the peripheral part 8. It is just as simple to merely change the peripheral part 8 by 180°. If the entire connector 6 is rotated around its axis by 180° relative to the housing 9 of the fitting, the pins 52 can be left in the recesses 53 and 54. Instead of pins 52, other suitable releasable connections are also conceivable. For example, the central part 7 can be designed unround, for example elliptical and similarly the recess 51.

In addition, with the axially extending pins 55 and 56 the central part 7 and the peripheral part 8 are connected in a twist-proof manner to the housing 9 of the fitting. The pins 55 and 56 are detachably inserted into corresponding holes 57, 58 and 59 in the connector 6 and the housing 9. Thus, the connector 6 is always rotated with the housing 9 of the fitting.

For a fitting without a return of the mixed water, the peripheral part 8 could be designed as a blind plate without bores 36 and 37. In this case a one-piece design of the connector would also be possible. Interchanging the hot and cold water feed pipes in this simpler design would also be possible by rotating the connector 180° with respect to the housing 9 of the fitting.

If it must be possible to interchange the hot and cold water feed pipes and to simultaneously interchange the mixed water discharge pipes, the connector could be designed as one piece. In this case the connector would still have to exhibit all four passages 34, 35, 36 and 37.

Common to all of the aforementioned designs of the connector is that it can be designed in a plate or disk-like shape, the height H being much smaller than the diameter. The height can amount, for example, to 2 cm and the diameter D to 6.5 cm. Since in all of the above variations the connecting housing 1 and the fitting housing 9 do not have to be modified, a modular system with such connecting devices is especially simple.

Figure 3:
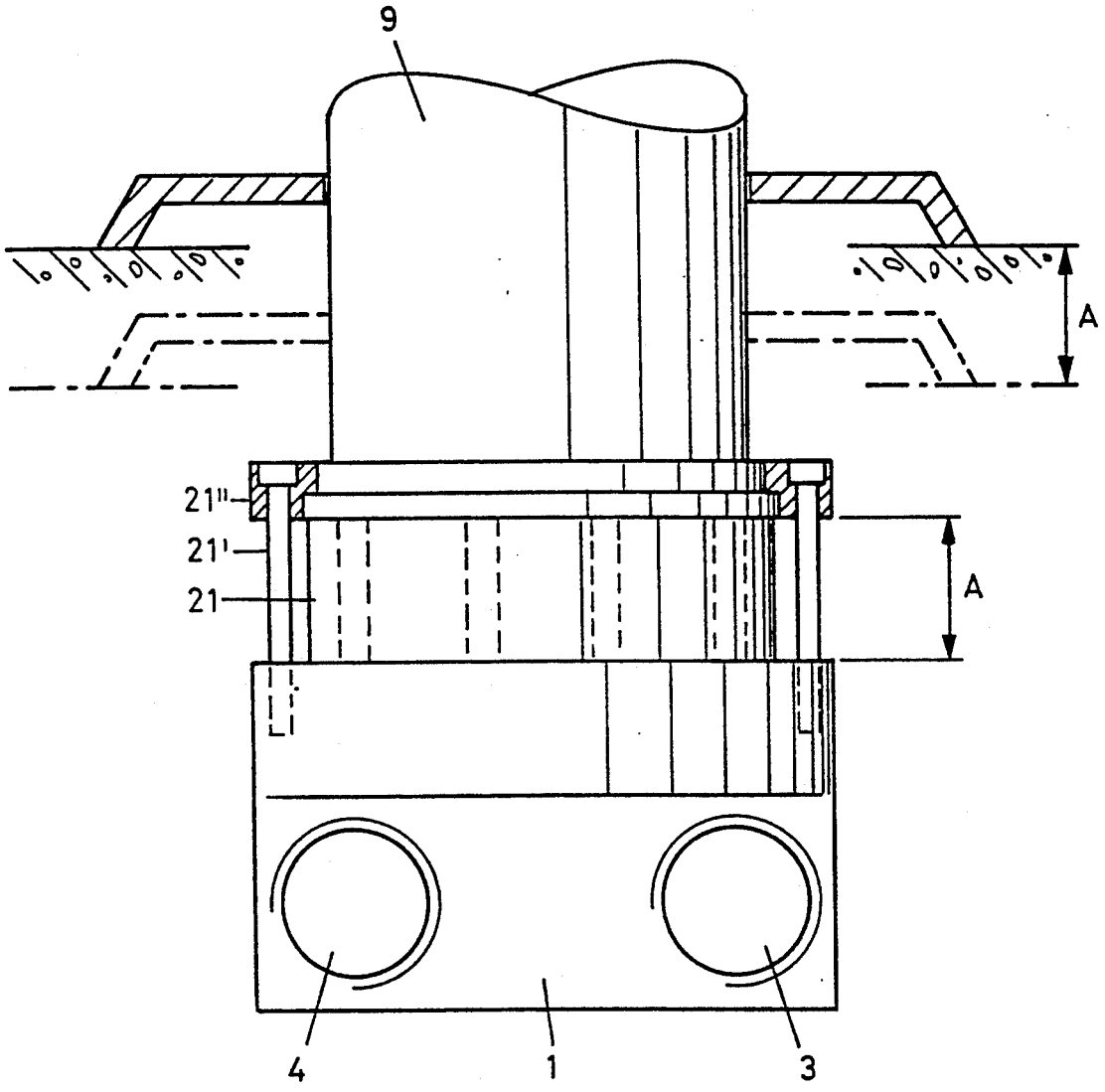
FIG. 3 is a side view of a connecting device for installation when the connecting housing is mounted excessively deep.

FIG. 3 is a side view of a connecting device with a housing 1 with two sockets 3, 4. The housing 1 contains the connector 6. Frequently during production a thicker plaster or coating layer is attached in an unanticipated manner so that the fitting housing 9 has to be mounted at a distance increased by distance A. Since, however, the outlets of the passages 34–37 in the connector 6 and those of the feed pipes 24–27 in the fitting housing 9 are always aligned with one other so as to fit, an adapter 21 having a height can be installed. With longer attachment screws 21' the fitting housing 9 can then be held at the housing 1 by means of the retaining ring 21''. Such an attachment guarantees that no water carrying parts are stressed by forces, but rather that the fitting housing 9 is attached directly to the housing 1.

We claim:

1. A connecting device for a sanitary appliance mixing valve, said connecting device comprising:

a) a first housing (1) having one pair of connection sockets for hot water feed lines and one pair of connection sockets for cold water feed lines, said housing defining a cylindrical recess (2) having a flat bottom surface (22), and a plurality of internal tap lines (14–17) individually extending from the sockets to said bottom surface, b) a second housing (9) mounted to the first housing over and closing the recess, said second housing being adapted to receive the mixing valve, and defining a plurality of feed passages (24,25) thereto, said passages terminating at a surface of the second housing facing the bottom surface of the recess, and c) a disc-like connector (6) disposed in the recess and defining, in a lower surface opposite the bottom surface of the recess, a plurality of concentric annular channels (18–20) individually communicating with said tap lines, and a plurality of through passages (34–37) extending through the connector from the annular channels to the feed passages, d) wherein at least a portion (7) of the connector carrying through passages (34,35) communicating with said feed passages (24,25) is rotationally displaceable through 180° to reverse hot and cold water feeds to the mixing valve, thereby correcting for improperly interchanged connections to the hot and cold water feed line sockets, and e) wherein resilient sealing means (40–43) are disposed at an upper surface and at the lower surface of the connector to seal the through passages of the connector to the first and second housings.

2. A connecting device as claimed in claim 1, wherein the connector is designed as one piece and has four passages such that, when the connector is displaced through 180°, the cold and hot water and mixed water discharge pipes are simultaneously interchanged.

3. A connecting device as claimed in claim 1, wherein the connector is designed as two pieces and comprises a central part (7) and a hollow cylindrical, peripheral part (8).

4. A connecting device as claimed in claim 3, wherein the peripheral part (8) is designed as a blind plate and the first housing has no mixed water return.

5. A connecting device as claimed in claim 1, wherein both sides of the connector are flat, and has a height (H) thereof which is substantially smaller than its diameter (D).

6. A connecting device as claimed in claim 1, wherein the connector can be rotated by 360° as a whole in the recess.

7. A connecting device as claimed in claim 3, wherein either the central part (7) within the peripheral part (8) or the entire connector can be interchanged by 180° relative to the second housing (9).

8. A connecting device as claimed in claim 1, wherein the connector (6) is held in place on the first housing (1) through a rigid attachment of the second housing (9).

9. A connecting device as claimed in claim 1, wherein the connector (6) is coupled in a twist-proof manner to the second housing (9) by axially extending connecting means (55,56).

10. A connecting device as claimed in claim 1, wherein the interface (A) between the connector and the second housing (9) is substantially flat.

11. A connecting device as claimed in claim 1, wherein the interface between the first housing (1) and the connector (6) is substantially flat.

12. A connecting device as claimed in claim 1, wherein one of the tap line (14) exits at a center of the bottom surface of the recess, and one of the connector through passages (34) extends from a center of the connector lower surface through the connector at an inclined angle, and does not communicate with an annular channel.

13. A device as claimed in claim 1, wherein the first housing further comprises a pair of connection sockets (5,5') for mixed water outlet lines, the second housing further defines a plurality of discharge passages (26,27) therefrom, and the through passages of the connector communicate with said discharge passages.

* * * * *